United States Patent [19]

Snyder et al.

[11] Patent Number: 4,525,138

[45] Date of Patent: Jun. 25, 1985

[54] FLAME SIGNAL ENHANCER FOR POST-MIXED BURNER

[75] Inventors: William J. Snyder, White Plains; Raymond H. Miller, Hopewell Junction; Hisashi Kobayashi, Putnam Valley, all of N.Y.

[73] Assignee: Union Carbide Corporation, Danbury, Conn.

[21] Appl. No.: 546,479

[22] Filed: Oct. 28, 1983

[51] Int. Cl.[3] ..... F23C 7/00

[52] U.S. Cl. ..... 431/187; 431/79; 431/354; 239/419; 239/433; 239/427.3

[58] Field of Search ..... 431/13, 79, 157, 187, 431/186, 284, 350, 354; 239/419, 433, 427.3; 60/726; 250/554

[56] References Cited

U.S. PATENT DOCUMENTS

| | | | |
|---|---|---|---|
| 1,339,579 | 5/1920 | Runyan | 239/433 |
| 1,512,132 | 10/1924 | Pfahl | 431/187 X |
| 2,632,501 | 3/1953 | Clark | 431/187 |
| 2,979,125 | 4/1961 | Katorsky | 431/79 |
| 3,021,386 | 2/1962 | Clark | 431/79 X |
| 3,299,841 | 1/1967 | Hemker et al. | 431/79 X |
| 3,748,087 | 7/1973 | Shular | 431/187 X |
| 3,905,751 | 9/1975 | Hemsath et al. | 431/183 |
| 3,990,835 | 11/1976 | Burton | 431/79 X |
| 4,023,921 | 5/1977 | Anson | 431/9 |
| 4,257,762 | 3/1981 | Zink et al. | 431/187 X |
| 4,378,205 | 3/1983 | Anderson | 431/5 |

*Primary Examiner*—Randall L. Green
*Attorney, Agent, or Firm*—Stanley Ktorides

[57] ABSTRACT

An apparatus for reliably monitoring a flame of a post-mixed burner without significantly altering the flame characteristics by forming a small but intense signal within the burner which is unaffected by furnace conditions and which corresponds to the actual flame.

9 Claims, 1 Drawing Figure

FLAME SIGNAL ENHANCER FOR POST-MIXED BURNER

TECHNICAL FIELD

This invention relates generally to post-mixed burners and in particular to post-mixed burners having concentric fuel and oxidant passages.

BACKGROUND ART

A post-mixed burner is a burner wherein fuel and oxidant are delivered in separate passages to a point outside the burner, such as a furnace, where the fuel and oxidant mix and combust. One often used arrangement of passages employs a central tube for delivery of fuel encompassed by an annular passage for delivery of oxidant. The oxidant in the annular passage may be the major oxidant for the burner or it may be a small oxidant stream employed for flame stabilization purposes.

A phenomenon which sometimes occurs with burners is a flameout wherein the flame or combustion reaction is extinguished. Flameout is a very dangerous conditions because fuel and oxidant are continuously delivered to the combustion zone, in, for example, a furnace, and if there is no combustion reaction occurring to consume these combustibles, the fuel and oxidant may build up to hazardous levels. For this reason the flame in a burner is generally continuously monitored by a flame detection device which is also in contact with the fuel and oxidant supply systems. Should the flame monitor fail to detect flame, indicating a flameout, it will shut off the fuel and oxidant supply streams and thus avoid the hazardous buildup of an explosive mixture in the furnace. In a burner having concentric fuel and oxidant passages the flame detector is can be positioned so that it sights down through the central tube. This arrangement provides a simple and convenient method to detect the flame without the complexity of a separate flame detector built into the burner. An often used type of flame detector is an ultraviolet light detector.

A recent significant advance in the field of post-mixed burners is the aspirating burner developed by Dr. John E. Anderson which is disclosed in U.S. Pat. No. 4,378,205, and U.S. Application Ser. No. 428,013. In this way the momentum of the oxidant and thus of the combustion reaction is preserved and heat is delivered evenly throughout the furnace. The aspirating burner is characterized by developing a combustion reaction having a dilute flame which does not emit a strong ultraviolet light. Depending on the design and operation of the burner, the intensity of the flame signal may fall below a minimum value to provide a steady ultraviolet signal to satisfy the flame detector. The flame detector thus reads no flame and shuts off the fuel and oxidant supply. This results in a time consuming restart of the burner and an inefficient combustion process.

Other factors which may affect the flame detector and result in nuisance false flameout readings include soot or other opaque substances within the furnace due to dirty fuels or incomplete combustion and a low reflecting central tube due to a soot or corrosion covered surface. Such a surface does not reflect a requisite amount of light for the flame detector to function properly.

These other factors which adversely affect the reliability of a flame detector exacerbate the flame monitoring difficulties discussed above for the aspirating burner.

One possible way of overcoming the problem of a false flameout reading is to increase the intensity of the flame by diverting the direction of the fuel and/or oxidant so that they mix and combust close to or right at the tip of the burner. However, this possible solution to the problem has severe drawbacks because the characteristics of the flame, i.e. flame shape, direction, etc. are significantly altered. This may have a detrimental effect upon the efficiency and quality of the combustion process.

It is thus desirable to provide a flame detection device which can reliably monitor a dilute flame under all furnace conditions without significantly altering the characteristics of the flame.

It is therefore an object of this invention to provide a flame signal enhancer for use with a post-mixed burner.

It is another object of this invention to provide a flame signal enhancer for a post-mixed burner which has increased reliability and will avoid a false flameout reading.

It is a further object of this invention to provide a flame signal enhancer for a post-mixed burner which will avoid a false flameout reading while not significantly altering the characteristics of the flame.

It is a still further object of this invention to provide a flame signal enhancer for a post-mixed burner which will avoid a false flameout reading despite a dilute flame.

SUMMARY OF THE INVENTION

The above and other objects which will become apparent to one skilled in the art upon a reading of this disclosure are attained by:

An apparatus for enhancing the flame signal of a post-mixed burner without significantly altering the flame characteristics comprising:

(a) a passageway formed by a tube wall comprised of oxidation resistant material, said passageway having a discharge end;

(b) a tube circumferentially around and axially along the tube wall defining an annular flow area between the tube and tube wall;

(c) a flame detector sighting down through the passageway;

(d) at least one connecting channel through the tube wall proximate the discharge end, communicating between the annular flow area and the passageway; and (e) a restriction in said annular flow area between the connecting channel and the discharge end such that the pressure of fluid in the annular flow area exceeds the pressure of fluid in the passageway.

As used herein the term "oxidation resistant" means significantly resisting oxidation at 800° C. in a combustion atmosphere.

DETAILED DESCRIPTION

Figure 1:
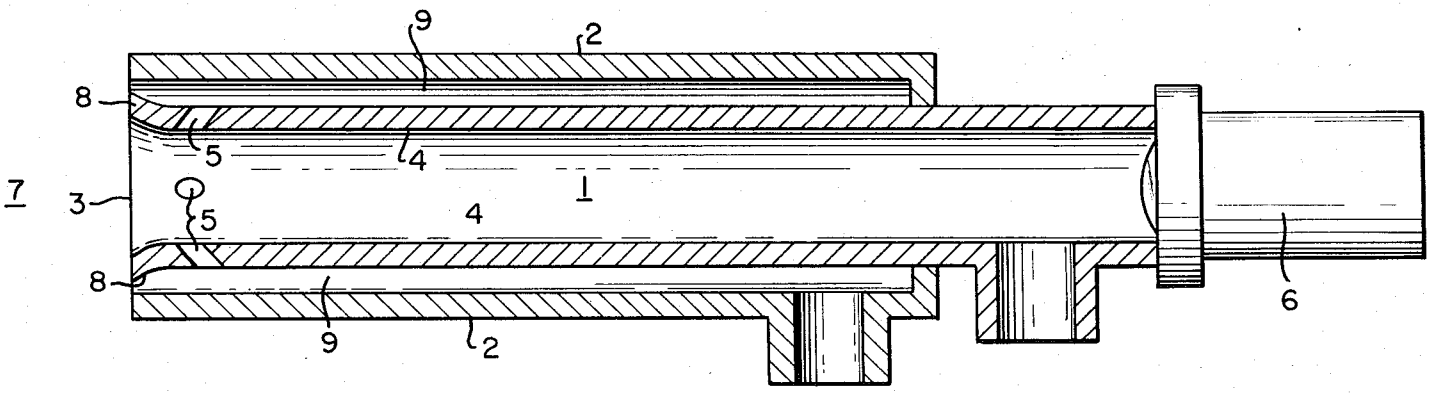
FIG. 1 is a cross-sectional representation of one preferred embodiment of the flame signal enhancer of this invention.

The flame signal enhancer of this invention will be described in detail with reference to the drawing.

Referring now to FIG. 1, passageway 1 is formed by tube wall 4 and is within tube 2 which runs axially along and circumferentially around passageway 1 and forms an annular flow area 9 between tube 2 and tube wall 4. Passageway 1 has a discharge end 3. The embodiment of FIG. 1 is a preferred embodiment wherein tube 2 extends to the same point, and has its discharge end at the same point, as discharge end 3.

Short of discharge end 3 and through tube wall 4, channel 5 communicates between passageway 1 and annular flow area 9. FIG. 1 illustrates a preferred embodiment wherein there is a plurality of channels 5 equispaced around tube wall 4. Channel 5 is preferably oriented at an angle with respect to the tube wall 4. Preferably the angle is in the range of from 15 to 75 degrees, most preferably at about 45 degrees. Channel 5 is preferably oriented in a direction from annular flow area 9 to passageway 1.

Between channel 5 and discharge end 3 there is a restriction 8 in annular flow area 9. In the FIG. 1 embodiment the restriction is effected by an outward flare on the end of tube wall 4. In this preferred arrangement the outward flare is at an angle of about 30 degrees. Any effective restriction means may be employed in this invention in place of the outward flare illustrated in FIG. 1. Among other useful restriction means one can name an inward flre of tube 2, a bump or a spoiler.

At a distance from discharge end 3 and sighting down through passageway 1 is a light detector 6. Preferably light detector 6 is an ultraviolet light detector although any effective light detector is useful in the apparatus of this invention. Light detector 6 sights down through passageway 1 and receives a signal produced by the flame from the combustion reaction in combustion zone 7. Should the flame signal dip below a minimum value, either because the flame goes out or conditions within the furnace reduce the flame intensity, the flame detector will activate a control system which will shut off the flow of fuel and oxidant.

In operation, fuel or oxidant flows though passageway 1 and the other of these two fluids flows through annular flow area 9. The apparatus of this invention will work satisfactorily with either fuel/oxidant arrangement. One preferred arrangement is to deliver fuel through passageway 1 and oxidant through annular flow area 9. It is particularly preferred that annular flow area 9 carry a minor oxidant stream which is employed for flame stabilization purposes. In this case the major oxidant for combustion is delivered to the combustion zone at a distance from the fuel. The operation of the apparatus of this invention will be described in conjunction with this preferred embodiment wherein fuel flows through passageway 1 and minor flame stabilization oxidant flows through annular flow area 9.

Fuel and oxidant flow out the discharge end of the burner into combustion zone 7 where they mix and combust. Light detector 6 receives the radiation from the combustion reaction through passageway 1 and allows the continued flow of fuel and oxidant.

A number of factors, either alone or in combination, may cause light detector 6 to falsely read a flameout and cause the flow of fuel and oxidant to be shut off. Dirty fuel, such as coke oven gas, flowing in passageway 1 may obscure the flame signal. Corrosion or soot may cause the inner surface of tube wall 4 to reflect very little or no light and thus further diminish the signal received by the flame detector. All these factors are magnified when the aforementioned aspirator burner is employed which has a characteristic dilute flame.

In order to avoid such nuisance false flameout readings the apparatus of this invention causes some oxidant flowing in annular flow area 9 to flow through channel 5 and mix with fuel flowing through passageway 1. The oxidant is caused to flow through channel 5 primarily by back pressure caused by restriction 8. The greater the amount of restriction on the flow area of annular flow area 9 the greater the amount of oxidant that will flow through channels 5 rather than out the discharge end of tube 2. The amount of oxidant flowing through channels 5 rather than out the discharge end of tube 2 is also directly related to the area of channel 5, the number of channels 5, and the angle which channels 5 form with tube wall 4.

Once the oxidant flows through channels 5 and combines with the fuel, a small combustion reaction occurs within passageway 1 in each area of mixture. Light detector 6 receives the light from these small combustion reactions and continues to allow continued fuel and oxidant flow irrespective of whether the light from the main combustion reaction is obscured.

Because of the intense flame which occurs in the area of the outlet of channel 5, it is imperative that tube wall 4 be made of a material which is oxidation resistant under these combustion conditions. A material which is not resistant to oxidation will, over time, foul channel 5 and render the flame detector of this invention inoperative. Suitable materials for tube wall 4 include ceramic, platinum, and Inconel TM which is an alloy of nickel, chromium and iron. Inconel is preferred. Copper, an often use material for burner tubes, is not resistant to oxidation under these combustion conditions and should not be used as the tube wall material.

The flame signal enhancer arrangement of this invention accurately and reliably monitors the flame irrespective of such conditions as excess soot, dirty fuel, dilute flame, fuel rich operation or other conditions which would tend to give a false flameout reading to the light detector.

Moreover, the flame signal enhancer arrangement of this invention accomplishes this accurate and reliable monitoring of the existance of combustion without any significant alteration of the flame characteristics. Any significant alteration of the flame characteristics would distort the temperature distribution within the furnace resulting in hot spots which cause inefficiencies and may cause damage to the furnace. The flame signal enhancer apparatus of this invention is able to successfully monitor the flame signal by signal enhancement without significantly altering the flame characteristics because very little of the fluid flowing in the annular flow area is diverted to the inner passageway. In the preferred embodiment of the invention which was discussed in detail, only a small amount of the annular oxidant, which itself is only a small amount of the total oxidant for the combustion reaction, is diverted into the central fuel passageway. Thus such drastic measures as diverting the major fuel or major oxidant stream to produce a more intense main combustion reaction are avoided.

Furthermore the flame signal enhancer apparatus of this invention accomplishes the beneficial results discussed above without compromising the intended safety features of a combustion detector. That is, should an actual flameout occur, the combustion within the inner passageway will be extinguished also. Thus the system of this invention will not cause the fuel and oxidant safety shut off system to be circumvented.

The apparatus of this invention has been discussed in detail with reference to an embodiment wherein fuel is delivered through the inner passageway and oxidant is delivered through the annular flow area. This is the preferred embodiment when the fuel is a relatively clear gaseous fluid. However, the apparatus of this invention will also function satisfactorily when oxidant is delivered through the inner passageway and fuel is delivered through the annular flow area. Such an arrangement may be preferred if the fuel were relatively dirty. The apparatus of this invention may be employed with any effective oxidant and is especially useful when the oxidant is relatively pure oxygen or oxygen-enriched air.

We claim:

1. An apparatus for enhancing the flame signal of a post-mixed burner without significantly altering the flame characteristics comprising:

(a) a passageway formed by a substantially cylindrical tube wall comprised of oxidation resistant material, said passageway having a discharge end;

(b) a tube circumferentially around and axially along the substantially cylindrical tube wall defining an annular flow area between the tube and substantially cylindrical tube wall;

(c) a flame detector which sights down through the passageway;

(d) at least one connecting channel through the substantially cylindrical tube wall proximate the discharge end, communicating between the annular flow area and the passageway; and (e) a restriction in said annular flow area between the connecting channel and the discharge end such that the pressure of fluid in the annular flow area exceeds the pressure of fluid in the passageway.

2. The apparatus of claim 1 wherein said oxidation resistant material is an alloy of nickel, chromium and iron.

3. The apparatus of claim 1 wherein the tube extends to the discharge end of the passageway.

4. The apparatus of claim 1 wherein the flame detector is an ultraviolet light detector.

5. The apparatus of claim 1 having a plurality of channels communicating between the annular flow area and the passageway.

6. The apparatus of claim 5 wherein said plurality of channels are equispaced around said tube wall.

7. The apparatus of claim 5 having four channels communicating between the annular flow area and the passageway.

8. The apparatus of claim 1 wherein the channel is oriented at an angle in the range of from 15 to 75 degrees with respect to the tube wall.

9. The apparatus of claim 1 wherein said restriction is formed by an outward flare on the end of the tube wall.

* * * * *